United States Patent [19]

Timphony et al.

[11] 4,317,301

[45] Mar. 2, 1982

[54] APPARATUS FOR STRETCHING FABRIC

[75] Inventors: Harold R. Timphony; Rene F. DeCastro, both of Gretna, La.

[73] Assignee: Nifty Enterprises, Inc., Gretna, La.

[21] Appl. No.: 150,405

[22] Filed: May 13, 1980

[51] Int. Cl.[3] ..... D06C 3/08

[52] U.S. Cl. ..... 38/102; 160/329; 254/217

[58] Field of Search ..... 38/102, 102.1, 102.4, 38/102.8, 102.9; 102.91; 160/328, 329; 297/44, 45; 254/217, 234

[56] References Cited

U.S. PATENT DOCUMENTS

| | | | |
|---|---|---|---|
| 280,489 | 7/1883 | Lindemann | 38/102 |
| 981,450 | 1/1911 | McClain | 38/102.1 |
| 1,456,311 | 5/1923 | Horsley | 254/234 |
| 1,703,879 | 3/1929 | Goldwyn | 297/45 |
| 1,913,710 | 6/1933 | Huff | 38/102 |
| 2,035,828 | 3/1936 | Nye et al. | 160/329 |
| 2,311,245 | 2/1943 | Pearl | 38/102 |
| 2,347,711 | 5/1944 | Redmond | 38/102.91 X |
| 2,693,340 | 11/1954 | Shirak | 254/217 |
| 3,466,706 | 9/1969 | Asano | 38/102.1 X |
| 4,190,974 | 3/1980 | Siler | 38/102.9 |

*Primary Examiner*—Louis Rimrodt
*Attorney, Agent, or Firm*—Nathaniel A. Humphries

[57] ABSTRACT

Apparatus is disclosed for disposing and stretching fabric about a frame, including first and second fabric locking members for releasably receiving and securing thereto the opposing peripheral edges, respectively, of a piece of fabric drawn about the frame. Each such locking member includes a support surface for receiving the frame, and a mechanism for releasably receiving and securing the fabric's edge in a manner that the fabric is disposed against the rear of the surface of the frame to facilitate the securing of the fabric by suitable fastening means, such as nails, tacks, etc. to the frame. In addition, there is provided a mechanism for independently supporting each of the first and second fabric locking members in a manner that the locking members may be variably disposed towards and away from each other to permit frames of varying sizes to be supported thereon and, upon securing the fabric to the first and second locking members, to stretch the fabric as the first and second locking members are disposed toward each other.

11 Claims, 11 Drawing Figures

Fig-8
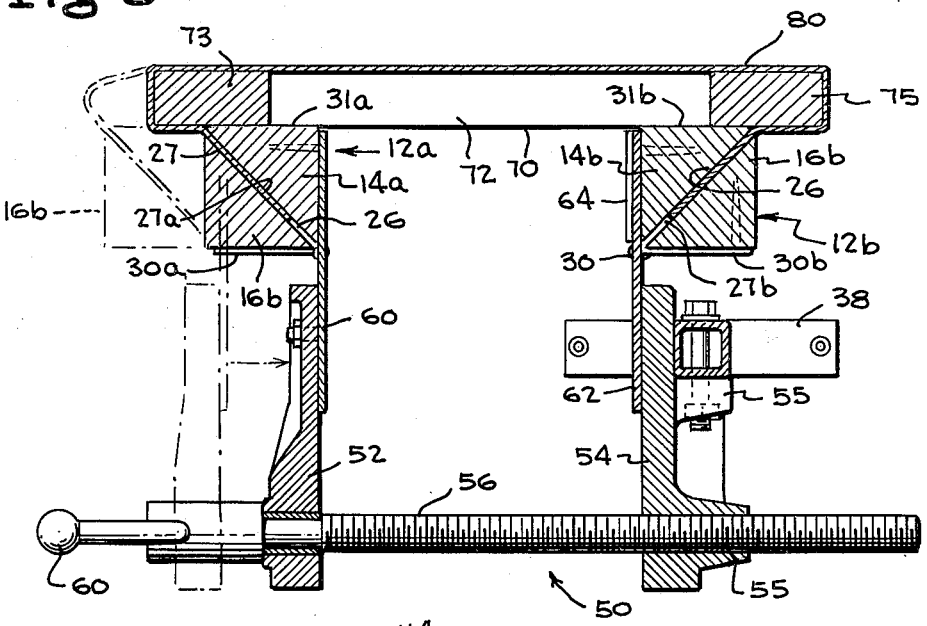
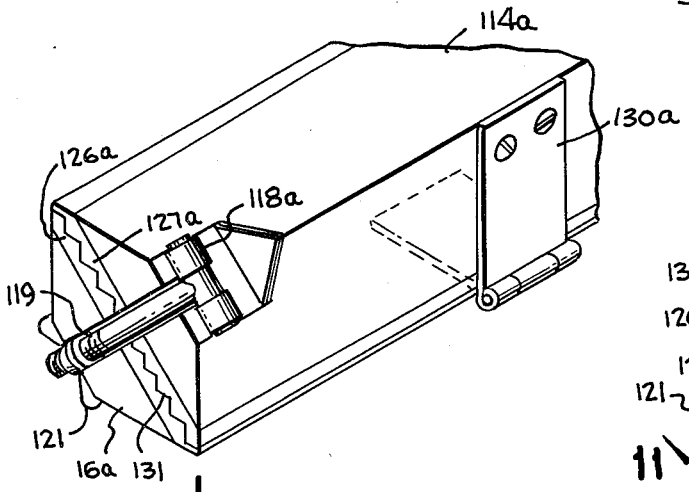
Fig-9
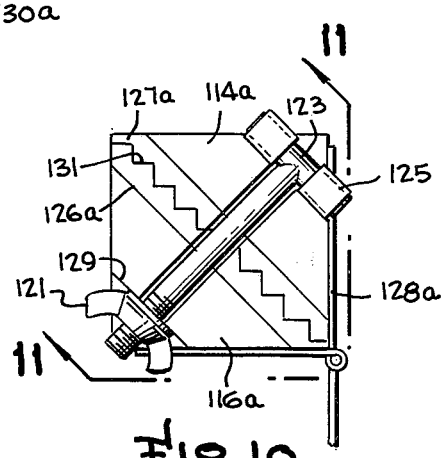
Fig-10
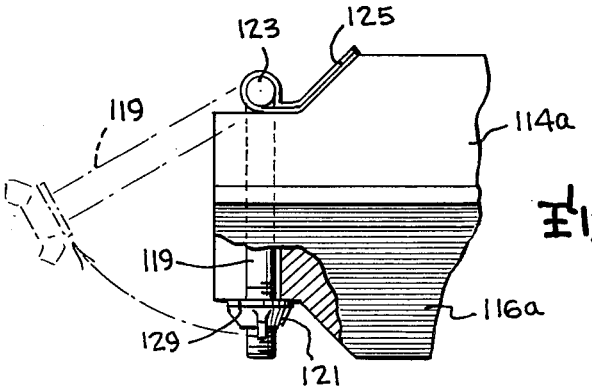
Fig-11

APPARATUS FOR STRETCHING FABRIC

DESCRIPTION

Background of the Prior Art

This invention, in its preferred form, relates to apparatus for facilitating the stretching of and securing a fabric to a frame.

In the prior art, it is well known to block a variety of fabrics, including canvas, needlepoint, crewel, embroidery, etc. by stretching to insure that the threads and/or any design borne by the fabric are oriented in a "square" fashion so as not to distort the appearance of the fabric or its design. In addition to stretching or shaping the fabric in a desired fashion, the stretched fabric may be attached by suitable means, such as staples, tacks, or an adhesive, to a frame whereby the fabric and/or its design may be appropriately displayed. Specifically, such a blocking process uses a blocking board bearing a series of holes aligned in straight lines forming a shape, typically a rectangle, corresponding to the desired shape in which the fabric is to be stretched. After the fabric has been stretched to insure that the threads of its fabric and/or its design are not distorted, the peripheral portions of the stretched fabric are secured to the board by a series of nails disposed through the fabric and into the board's holes. Thereafter, the fabric may be secured to a suitably shaped and dimensioned frame by the use of suitable fastening means, such as tacks, staples, or an adhesive. Such a process is described in an article entitled "Professional Ease in Blocking Needlepoint" appearing in the May 1979 issue of Decor. The noted article describes a blocking board comprised of a series of concentric, rectangular outlines, each such outline having a plurality of holes therealong for receiving rustproof aluminum nails. The article describes a process of blocking whereby the fabric to be stretched is moistened and thereafter is placed upon the board in a manner that the periphery of the fabric to be stretched is aligned with or made parallel to selected of the rectangular outlines. First, two edges of the fabric's periphery are aligned with at least two straight lines of selected rectangular outlines and the aluminum nails are placed in the corners of the fabric. Thereafter, the operator stretches or pulls the fabric to insure that the design and/or threads are square and not distorted before placing a series of the nails through the fabric and into the board's holes. Thereafter, suitable fasteners are used to secure the fabric to the frame whereby the fabric, as stretched, is permanently secured to the frame.

There are two problems associated with such a process; the first involves the amount of time that is required by the operator to stretch by hand without damaging the fabric and to insert the nails to insure that the design or the threads of the fabric are square and are not distorted. The second related problem is the difficulty in applying even tension along the periphery of the fabric. Further, the use of the described mounting board encourages the operator to secure the fabric to the board by inserting fastening means, such as staples, through the front of the fabric and into a front surface of the frame as opposed to the side or back surface, i.e., a surface remote from the front of the fabric.

A variety of devices have been suggested by the prior art to assist the stretching process. U.S. Pat. No. 2,347,771 of Redmond suggests a rectangularly shaped frame comprised of four side members adjustably secured together at one end thereof to permit a side member to be moved in a rectilinear fashion with respect to each of its adjoining side members; each side member includes a clamp comprising a pair of mating blocks presenting a ridge surface to each other. The opposing blocks may be opened to receive the peripheral edge of a fabric, such as a curtain material, and clamping means are provided to dispose the mating blocks together to hold by the ridge surface the peripheral edge of the fabric. Stretching is accomplished by applying pressure to the side members in an outward direction and then locking the side members in place.

U.S. Pat. No. 2,693,340 of Shirak and U.S. Pat. No. 981,450 of McClain both show lever-type means for applying tension to a piece of fabric. In particular, the Shirak patent '340 shows a cylinder bearing a series of teeth for receiving and holding a web and a lever for rotating the the cylinder whereby the fabric is stretched about a frame to which the fabric is secured by simple fastening means, such as nails. The McClain patent '450 is particularly adapted to stretch rugs and suggests the use of a frame having a first edge member to which a corresponding edge of the rug is secured by nailing. Thereafter, a lever stretching mechanism, as disposed on an opposing, substantially parallel edge member of the frame, is incrementally moved along that corresponding edge to sequentially stretch edge portions of the rug. The stretching mechanism comprises a pivotally mounted lever to which is attached a pair of clamping members. The clamping members may be manually operated to secure a portion of the rug and thereafter, while still in a fabric clamping position, the lever is pivotally rotated to exert pressure to stretch the clamped portion of the rug. As each incremental portion of the rug is so stretched, a nail is disposed through the rug and into the opposing edge member of the frame.

U.S. Pat. No. 1,456,311 of Horsley discloses a mechanism for drawing the ends of a band or bale tie about an object such as a cotton bale. The drawing mechanism includes a screw, which is operatively coupled to two blocks, each of which is secured to an end of the bale. The screw is coupled to a handle that is rotated whereby the blocks, and thus the ends of the bale, are drawn together to be secured together by a buckle.

The prior art has not successfully addressed the problem of disposing and stretching fabric in a manner that may be accomplished easily and efficiently to reduce the required operator time and in a manner that assures the application of even pressure along the peripheral portions of the fabric. Further, the prior art methods of apparatus for fabric stretching have not been particularly adapted to dispose the fabric about the frame in a manner to permit the fastening means to be readily disposed through the fabric and to a side or rear surface of the frame.

BRIEF SUMMARY OF THE INVENTION

It is an object of this invention to provide apparatus that will permit the disposition and stretching of fabric about a frame in an efficient, time-saving manner.

It is a further object of this invention to provide apparatus for disposing fabric about a frame in a manner that will apply even tension to the periphery of the fabric.

It is a still further object of this invention to provide apparatus that will dispose and stretch a fabric about the frame in a manner to permit the fabric while stretched to be secured to the frame either upon a side or rear surface thereof.

In accordance with these and other objects of the invention, there is disclosed apparatus for disposing and stretching fabric about a frame, including first and second fabric locking members for releasably receiving and securing thereto the opposing peripheral edges, respectively, of a piece of fabric drawn about the frame. Each such locking member includes a support surface for receiving the frame, and a mechanism for releasably receiving and securing the fabric's edge in a manner that the fabric is disposed against the rear of the surface of the frame to facilitate the securing of the fabric by suitable fastening means, such as nails, tacks, etc. to the frame. In addition, there is provided a mechanism for independently supporting each of the first and second fabric locking members in a manner that the locking members may be variably disposed towards and away from each other to permit frames of varying sizes to be supported thereon and, upon securing the fabric to the first and second locking members, to stretch the fabric as the first and second locking members are disposed toward each other.

In an illustrative embodiment of this invention, each of the locking members comprises a first clamping jaw that is secured to the supporting and disposing mechanism, a second clamping jaw, and a hinge for permitting the rotation of the second clamping jaw with respect to the first clamping jaw between a first closed position wherein a peripheral edge of the fabric is secured to its locking member, and a second open position wherein the fabric may be received or released from the locking member. Each of the clamping jaws has a fabric gripping surface which may illustratively take the form of a sheet of sandpaper or a sawtooth-shaped surface.

In a further aspect of this invention, the mechanism for supporting and disposing may illustratively take the form of a vise having a first movable block for supporting the first fabric locking member, a second relatively stationary block for supporting the second fabric locking member, and a screw adapted to be rotated to movably dispose the movable block in rectilinear fashion with respect to the stationary block.

In a still further aspect of this invention, the noted vise may be supported upon an arm that is rotatively mounted about a fixed surface, e.g., a table, in a manner to permit an operator to rotate the vise and therefore the frame as covered by a piece of stretched fabric and thus to facilitate the insertion of suitable fastening means through the fabric and into the frame.

In another aspect of this invention, an auxiliary locking member may be provided similar to the aforementioned locking members and includes supports in the form of a pair of brackets whereby the auxiliary locking member may be mounted upon the relatively stationary block to permit frames of larger dimensions to be supported upon the locking members.

BRIEF DESCRIPTION OF THE DRAWINGS

A detailed description of one preferred embodiment of this invention is hereafter described with specific reference being made to the drawings in which:

FIG. 8 is a sectional view of the fabric stretching apparatus taken along the line 8—8 as shown in FIG. 7;

FIG. 9 is a perspective view of a locking member in accordance with a further embodiment of this invention;

FIG. 10 is an end view of the locking member as shown in FIG. 9; and

FIG. 11 is a view of the locking member taken in accordance with lines 11—11 as shown in FIG. 10.

DETAILED DESCRIPTION OF THE INVENTION

Figure 1:
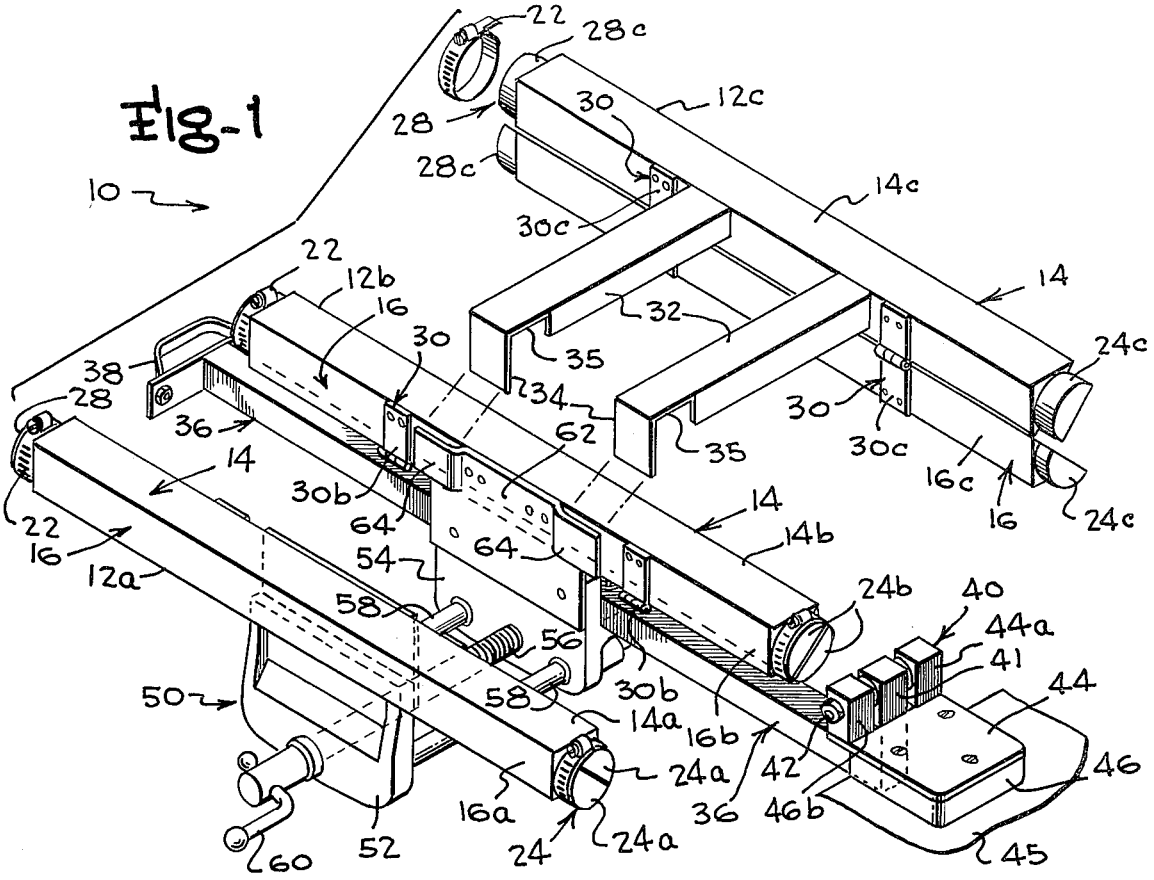
FIG. 1 is a perspective view of the apparatus for stretching fabric illustrating the assembly of such apparatus with an auxiliary locking member.
Figure 4:
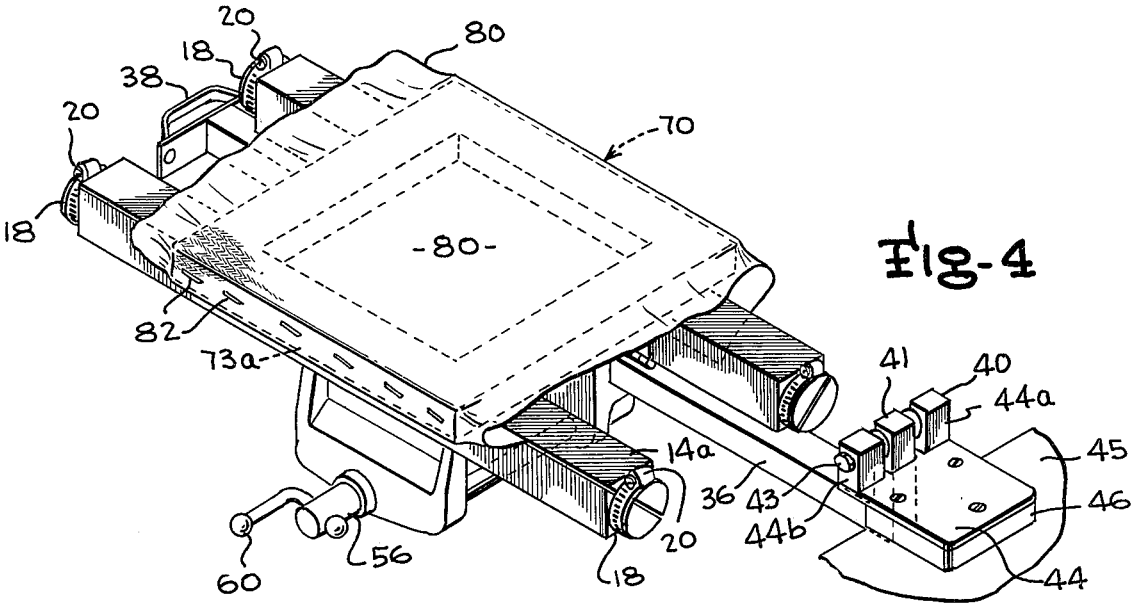

Referring now to the drawings, and in particular to FIG. 1, there is shown the preferred embodiment of the inventive apparatus 10 for stretching fabric preparatory for attachment to a frame 74. In particular, the apparatus 10 includes first and second locking members **12*a* and 12*b*, each capable of receiving and securing thereto the peripheral edge of a piece of fabric 80 as more specifically shown in FIGS. 4 and 8. As particularly illustrated in FIG. 1, there is also included an auxiliary locking member 12*c* that may be attached to associated support means in a manner to be described, to provide facility for receiving a frame of increased dimension. As shown in FIGS. 1 and 8, each of the first, second, and auxiliary locking members 12*a*, 12*b*, and 12*c*, includes first and second clamping jaws 14 and 16 hinged together by a pair of hinges 30. The elements forming the locking members 12 are marked with the letters a, b, and c, denoting, respectively, that they are a part of the first, second, or auxiliary locking members 12, 12*b*, or 12*c***.

As particularly shown in FIG. 8, each of the clamping jaws 14 and 16 includes, respectively, a gripping surface 27 and 26 for receiving and securing a peripheral portion of the piece of fabric 80 therebetween. The clamping jaws 14 and 16 are made of wood, and their gripping surfaces 27 and 26 are formed by sheets of sandpaper secured by a suitable adhesive to the jaws 14 and 16. As particularly shown in FIG. 1, circularly shaped projections 24 and 28 are disposed on opposite ends of each of the locking members 12; each such projection is comprised of the end portions of the locking jaws 14 and 16. Securing or clamping means is provided in the form of an aviation clamp 18 disposed about the circular projection 24 and a second aviation clamp 22 disposed about the projection 28.

As shown in FIGS. 1 and 8, each of the first and second locking members **12*a* and 12*b* are mounted upon and supported by a vice 50. The vise 50 includes a movable block 52 and a relatively stationary block 54. A screw 56 is rotatively disposed through the movable block 52 and through an opening 55 disposed within the relatively stationary block 54. The opening 55 has a set of threads for matching those of the screw 56, whereupon rotation of a crank 60 secured to one end of the screw 56, the threads of the screw 56 engage those of the opening 55 to move the movable block 52 in a rectilinear fashion with respect to the stationary block 54, as illustrated particularly in FIG. 8**.

Figure 2:
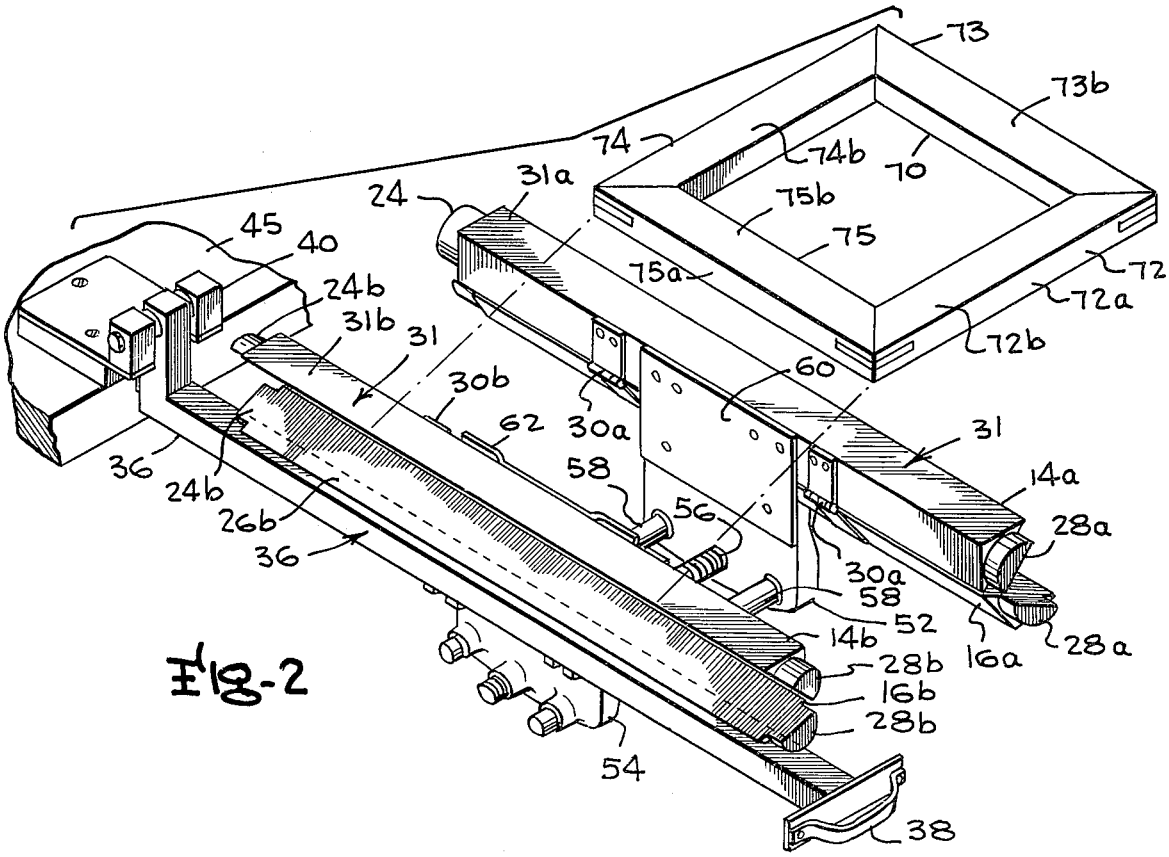
FIG. 2 is a perspective view showing the manner in which a frame, about which fabric is to be stretched, is supported by the apparatus of the subject invention as shown in FIG. 1.
Figure 3:
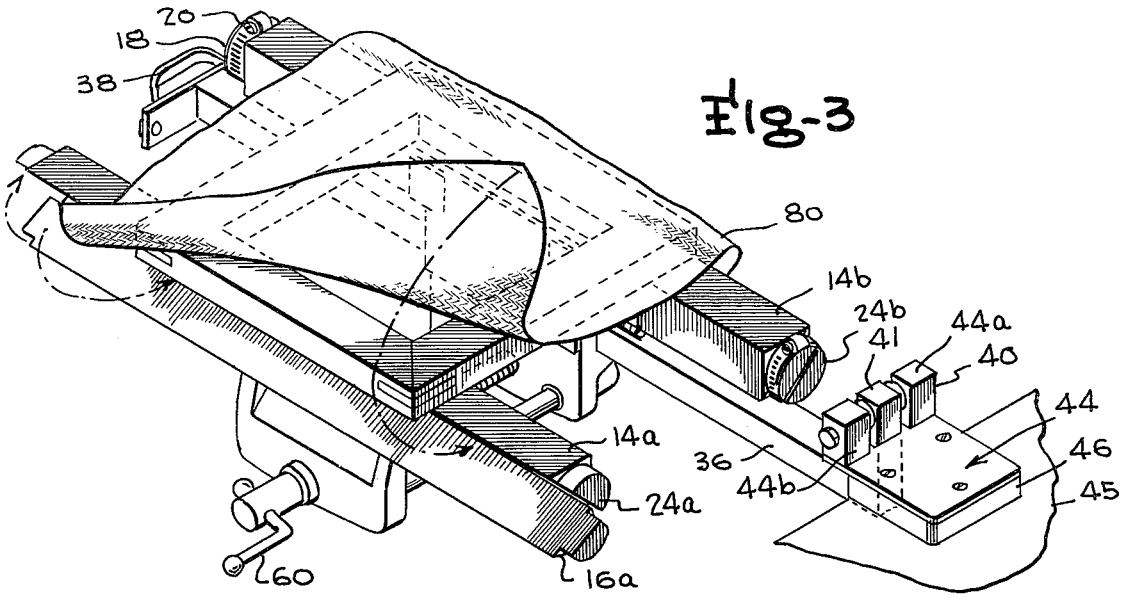
FIGS. 3 and 4 are, respectively, perspective views showing the manner in which the fabric is disposed about the frame and is secured by the locking members of the stretching apparatus.

As shown in FIGS. 1 and 8, support plates 60 and 62 are mounted and secured to the blocks 52 and 54, respectively. The locking member 12*a* is secured to the plate 60 by well known means such as screws disposed through openings within the plate 60; the locking member 12*b* is similarly secured to the plate 62. As illustrated in FIGS. 1–8, the locking members 12 are made of wood and may be readily secured to their support plates by wood screws. As illustrated in FIGS. 2 and 8, each of the clamping jaws 14*a* and *b* (and 14*c*) includes a surface 31 for receiving and supporting the frame 70.

As particularly shown in FIGS. 2, 6, 7, and 8, the vise 50 is mounted upon and secured to a rotationally movable arm 36 having an operator graspable handle 38 mounted at one end to facilitate rotation of the arm 36. As particularly illustrated in FIG. 7, the arm 36 and therefore the vise 50 and the locking members 12, are rotatively movable about a horizontal pivot axis 40 from a first position as shown in full line in FIG. 7 through a vertical angular range to a position wherein the arm 36 extends horizontally, as shown in broken line in FIG. 7. As particularly shown in FIGS. 1 and 6, the arm 36 includes an extending member 41 having an opening therethrough for receiving a bolt 42. The arm 36 is pivotally mounted by a hinge generally designated by the numeral 40 and including a hinge plate 44 mounted upon a work surface 45 by a set of screws disposed through the plate 44 and a spacer 46. The hinge 40 also includes a pair of upright members 44*a* and 44*b* spaced from each other for receiving therebetween the extending member 41 of the arm 36, and each having an opening therein for receiving the bolt 42, whereby the arm 36 is pivotally mounted. A nut 43, shown in FIG. 6, secures the bolt 42 within the openings of the members 44*a* and 44*b* and 41.

Figure 5:
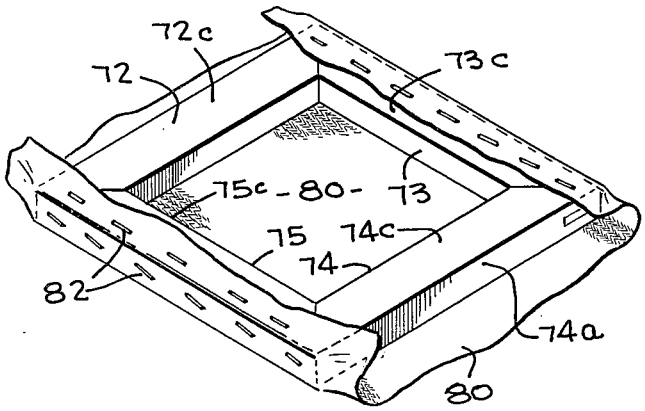
FIG. 5 is a perspective view showing particularly the rear surface of the frame and the manner in which the fabric is secured thereto.
Figure 6:
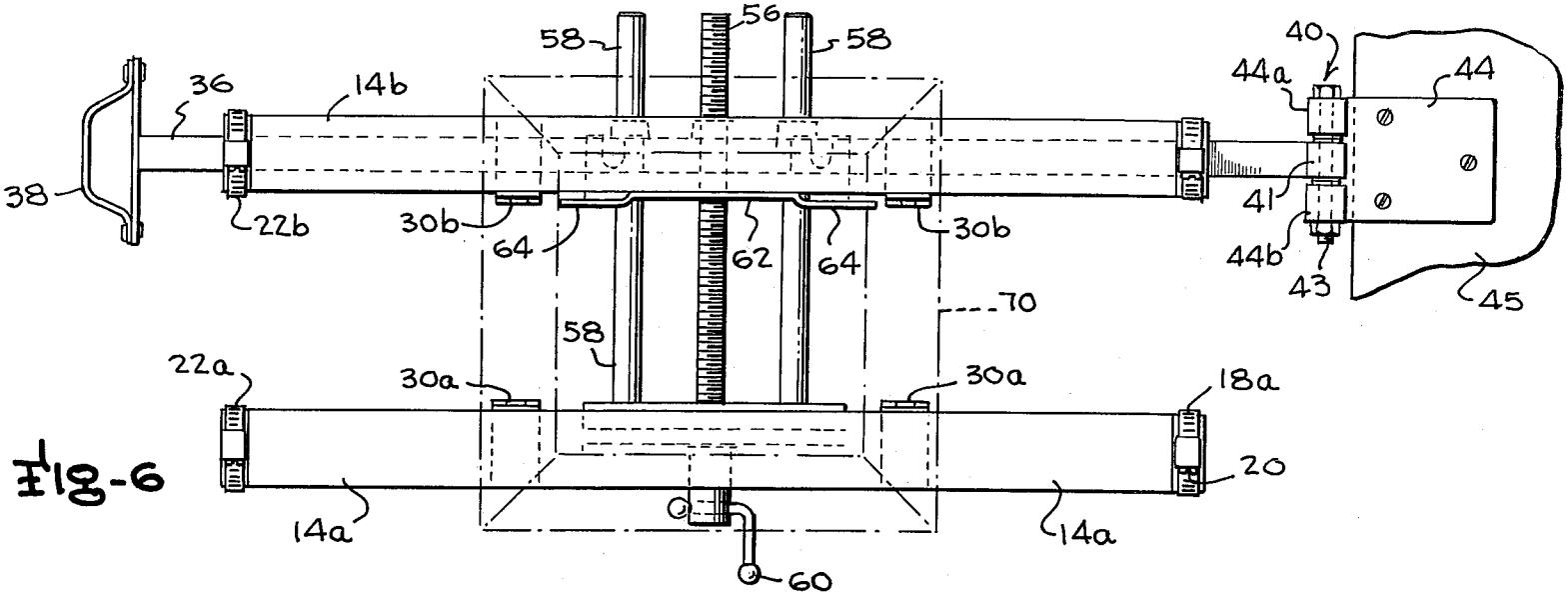
FIGS. 6 and 7 are, respectively, a plan and a side view of the stretching apparatus as shown in FIG. 1.
Figure 7:
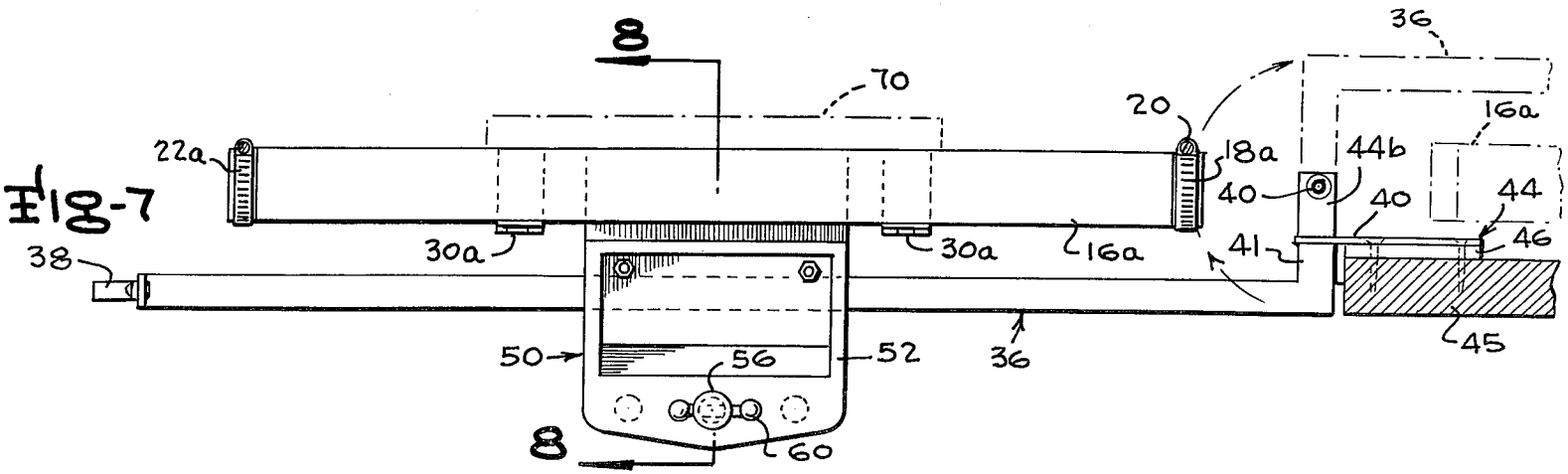

The frame 70 is best illustrated in FIGS. 2 and 5 and comprises four side members 72, 73, 74, and 75, each end of which is joined to a further side member and attached thereto in a conventional manner. Side member 72 includes a side surface 72*a* and a top surface 72*b*, as illustrated in FIG. 2, and a bottom surface 72*c*, as shown in FIG. 5. It is noted that the other side members 73, 74, and 75 have similarly marked surfaces.

The method of disposing the fabric 80 about the frame 70 and securing the fabric 80 to the frame 70 in an efficient and facile manner will now be explained with respect to FIGS. 2, 3, 4, 5, 7, and 8. First, the crank 60 is rotated to position the locking member 12*a* to a position, as shown in broken line in FIG. 8, to receive the rear surface of the frame 70 and to be disposed with respect to the sides of the frame 70 so that the peripheral portions of the fabric 80 may be readily disposed between the clamping jaws 14 and 16 of each of the locking members 12*a* and 12*b*. It is contemplated that the fabric 80 may be prepared for stretching by dampening with a suitable liquid such as water. After wetting, the fabric 80 is disposed about the frame 70 in a manner as shown in FIG. 8 and the overlapping or peripheral portions of the fabric 80 are disposed between the open clamping jaws 14 and 16 of the locking members 12*a* and 12*b*. Next, the clamping jaws 14 and 16 are closed, and a suitable locking means such as the aviation clamp 18 is disposed about the projection member 24 and secured by tightening its screw 20 thus pulling the ends of the aviation clamp 22 together; in a similar manner, the aviation clamp 22 is disposed about the projection 28 on the other end of the locking means 12. Thus, the peripheral or overlapping portion of the fabric 80 is secured tightly between the clamping jaws 14 and 16 in a manner whereby, respectively, the surfaces 27 and 26 engage and secure the fabric 80 to its locking member 12. With the peripheral or overlapping portions of the fabric 80 secured to the locking members 12, the operator manipulates the crank 60 to rotate the screw 56 to move the block 52 from its first position shown in broken lines in FIG. 8 to its second position shown in full lines, thereby closing the vise 50 and stretching the fabric 80 about the frame 70.

After the fabric 80 has been disposed and stretched about the frame 70, the operator secures the fabric 80 to the frame 70 by a suitable fastening means, such as staples or tacks. To facilitate the securing of the fabric 80 to the side surface of the frame 70, the operator may dispose the arm 36 by grasping its handle 38 to either the first, horizontal position, as shown in full line in FIG. 7, or to the vertical position, as shown in broken line in FIG. 7, wherein the side surfaces 73*b* and 75*b* of the members 73 and 75 are disposed in an upright position. Next, it desired, the operator may continue to rotate the arm 36 to a third position, as shown in broken line in FIG. 7, wherein the frame 70 is disposed with its rear surfaces 72*a*, 73*c*, 74*c*, and 75*c* exposed to permit the operator to place staples 82 through the fabric 80 and into the aforenoted rear surfaces of the frame 70. In this regard, the operator may choose to staple the fabric 80 to either the side or rear surfaces or both, as the characteristics of a particular fabric or frame may dictate. After the fabric 80 has been stretched and its peripheral portions secured to the side members 73 and 75, as shown in FIG. 5, the fabric is released from the locking members 12*a* and 12*b*, and the peripheral portion of the fabric extending beyond the side members 72 and 74 is secured in a similar manner by staples 82 to the frame 70. Thereafter, if the fabric 80 has been previously wetted, the secured fabric 80 is permitted to dry and thereby to stretch tautly the fabric 80 about the frame 70.

As particularly seen in FIG. 8, the first and second locking members are respectively secured to the plates 60 and 62. The first and second locking members 14*a* and 14*b* further comprise support surfaces 31*a* and 31*b*, respectively, for receiving the rear surface of the frame 70. The securing surfaces 27*a* and 27*b* of the locking jaws 14*a* and *b*, respectively, are disposed at an angle to or on a diagonal to intersect their support surfaces 31. As a result, as the movable block 52 is disposed from its extended to its closed position, as shown in FIG. 8, the fabric 80 is stretched about its frame 70 in a manner that the fabric 70 is disposed tautly against the rear surfaces 75*c* and 73*c* of the frame 70. In this manner, the operator may readily insert a fastener, such as the staples 82, into either side surfaces 75*b* or 73*b*, and/or rear surfaces 75*c* or 73*c*.

In a further aspect of this invention, as illustrated in FIG. 1, frames 70 of larger dimensions may be accommodated by the use of the auxiliary locking member 12*c*. In particular, the locking member 12*c* has a pair of extending brackets 32 with fingers 34 extending downwardly, as shown in FIG. 1, to engage the plate 62. Further, each of the brackets 32 has an opening 35 that is of a configuration to receive the locking member 12*b*. Thus, as illustrated in FIG. 1, the fingers 34 are adapted to be disposed within slots formed by a pair of support wings 64 extending from the plate 62. As a result, the auxiliary locking member 12*c* may be mounted upon the locking member 12*b* and secured to the plate 62 whereby frames 70 of larger dimension may be disposed upon the upper surfaces of the clamping jaws 14 and a piece of fabric 80 stretched about and secured to the frame in a manner as explained above.

In FIGS. 9–11, there is shown a further aspect of this invention involving the means for securing the clamping jaws of a locking member together. The elements, as shown in FIGS. 9–11, are designated with numerals similar to those shown in the remaining figures except that they are numbered in the hundred series. The fastening means shown in the embodiment illustrated in FIGS. 9–11 take the form of a dog bolt 119 comprising a post 123 as pivotally mounted by a bracket 125 attached to the clamping jaw 114*a*. As particularly shown in FIG. 11, the dog bolt 119 may be rotatively moved from a first position, as shown in broken line, wherein the clamping jaws 114*a* and 116*a* are in an open position to a second closed position, as shown in FIG. 11 by full line, wherein the clamping jaws 114*a* and 116*a* are disposed in a fabric securing position. After the fabric 80 has been secured between the clamping jaws 114*a* and 116*a*, a wing bolt 121 may be threaded about the dog bolt 119 to abut in an engaging fashion a beveled surface 129. Further, the securing surfaces 126*a* and 127*a* of the clamping jaws 116*a* and 114*a*, respectively, may take the form of a series of complimentary sawteeth 131 for securing a fabric therebetween. Illustratively, the sawtooth surface 131 may be formed by extruded members. In an illustrative embodiment of this invention, the clamping jaws 114 and 116, as shown in FIGS. 9–11, may be made of sheet metal.

Thus, there has been shown apparatus for stretching fabric that permits an operator to wrap and stretch a piece of fabric about a frame in an efficient manner requiring a minimum of operator time. Further, the apparatus of this invention insures that the fabric is stretched with even tension applied along its periphery to insure that the threads or any design appearing upon the fabric will not be distorted. Further, the described apparatus permits the operator to secure the fabric to the side and/or rear surfaces of the frame, as the characteristics of the frame or fabric may require.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

We claim:

1. Apparatus for disposing and stretching fabric about a frame of a configuration having opposed lateral edges, a front surface about which the fabric is to be disposed, and a rear surface, the fabric having opposing peripheral edges, said apparatus comprising:

first and second fabric locking means for releasably receiving and securing thereto the opposing edges of the fabric with the fabric disposed about the front surface of the frame, each of said first and second fabric locking means comprising a support surface for supporting the rear surface of the frame, and means for releasably receiving and securing an edge of the fabric so that the fabric is disposed against the rear surface of the frame; and means for independently supporting each of said first and second fabric locking means and variably disposing said first and second fabric locking means towards and away from each other whereby said first and second fabric locking means are disposed so that their support surfaces may support frames of varying size and so that the fabric secured in each of said fabric locking means is stretched about the frame as said first and second locking means are disposed to stretch the fabric about the frame.

2. The disposing and stretching apparatus as claimed in claim 1, wherein each of said first and second fabric locking means comprises first and second clamping jaws, each of said first and second clamping jaws has a fabric securing surface, hinge means for rotatively disposing said second clamping jaw between a first closed position wherein a peripheral edge of the fabric is secured between said fabric securing surfaces of said first and second clamping jaws, and a second open position wherein the fabric may be received or released from between said first and second clamping jaws.

3. The disposing and stretching apparatus as claimed in claim 2, wherein said first clamping jaw includes said support surface and is secured to said supporting and disposing means.

4. The disposing and stretching apparatus as claimed in claim 3, wherein said securing surface of said first clamping jaw is oriented to intersect said support surface of said first locking jaw whereby when said second clamping jaw is disposed to its first position to secure the fabric between said first and second locking jaws that the fabric is disposed against the rear surface of the frame to permit an operator to readily secure the fabric to the frame.

5. The disposing and stretching apparatus as claimed in claim 2, wherein each of said first and second locking means includes means for securing said first and second clamping jaws in their first position thereby securing the peripheral edge of the fabric between said securing surfaces of said first and second clamping jaws.

6. The disposing and stretching apparatus as claimed in claim 5, wherein said securing means comprises an aviation clamp disposed about at least one end of each of said first and second fabric locking means.

7. The disposing and stretching apparatus as claimed in claim 5, wherein said securing means comprises a dog bolt having one end thereof rotatively coupled to one of said first and second clamping jaws and the other end threaded for receiving a nut adapted to abut the other of said first and second clamping jaws, whereby said second clamping jaw is secured in its first position.

8. The disposing and stretching apparatus as claimed in claim 1, wherein said supporting and disposing means comprises a vise including a first movable block for supporting said first fabric locking means, a second relatively stationary block for supporting said second fabric locking means, and a screw adapted to be rotated to movably dispose said movable block in rectilinear fashion with respect to said stationary block.

9. The disposing and stretching apparatus as claimed in claim 8, further comprising an arm having a first end rotatively disposed about a stationary point and fixedly secured to said stationary block, whereby said vise may be rotated to position the supported frame in a plurality of positions to facilitate securing of the fabric to the frame.

10. The disposing and stretching apparatus as claimed in claim 9, wherein said arm includes a second end having handle means adapted to be readily grasped by an operator.

11. The disposing and stretching apparatus as claimed in claim 8, wherein there is included an auxiliary locking means including a support surface for receiving and supporting the rear surface of the frame, means releasably receiving an edge of the fabric so that the fabric is disposed against the rear surface of the frame, and means adapted to be releasably attached to said stationary block for supporting said auxiliary locking means remotely with respect to said first locking means.

* * * * *